US011226150B2

(12) United States Patent
Park et al.

(10) Patent No.: US 11,226,150 B2
(45) Date of Patent: Jan. 18, 2022

(54) DEFROSTING DEVICE AND REFRIGERATOR HAVING THE SAME

(71) Applicant: LG ELECTRONICS INC., Seoul (KR)

(72) Inventors: Yonggap Park, Seoul (KR); Kwangsoo Jung, Seoul (KR); Woocheol Kang, Seoul (KR); Geunhyung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/502,790

(22) PCT Filed: Aug. 1, 2016

(86) PCT No.: PCT/KR2016/008433
§ 371 (c)(1),
(2) Date: Feb. 9, 2017

(87) PCT Pub. No.: WO2017/034170
PCT Pub. Date: Mar. 2, 2017

(65) Prior Publication Data

US 2018/0156523 A1 Jun. 7, 2018

(30) Foreign Application Priority Data

Aug. 24, 2015 (KR) ..... 10-2015-0119087

(51) Int. Cl.
*F25D 21/12* (2006.01)
*F25B 47/02* (2006.01)
(Continued)

(52) U.S. Cl.
CPC ..... *F25D 21/12* (2013.01); *F25B 39/02* (2013.01); *F25B 39/022* (2013.01); *F25B 47/02* (2013.01);
(Continued)

(58) Field of Classification Search
CPC ..... F25D 21/12; F25D 21/06; F25D 21/08; F25B 47/02; F25B 47/022;
(Continued)

(56) References Cited

U.S. PATENT DOCUMENTS 2,631,442 A * 3/1953 Melcher ..... F25D 21/12 62/267
7,565,065 B2 * 7/2009 Kato ..... F24H 1/102 392/465

FOREIGN PATENT DOCUMENTS

JP 1993346284 12/1993
JP H07-190597 7/1995
(Continued)

OTHER PUBLICATIONS

Partial English Machine Translation JP-08303932. Accessed Mar. 2019.*
(Continued)

*Primary Examiner* — Tavia Sullens
(74) *Attorney, Agent, or Firm* — Fish & Richardson P.C.

(57) ABSTRACT

The present invention discloses a defrosting device, including: a heating unit provided at a lower portion of the evaporator; and a heat pipe connected to an inlet and an outlet of the heating unit, respectively, and having at least part thereof disposed adjacent to a cooling pipe of the evaporator such that the cooling pipe of the evaporator is heated by a working fluid of high temperature which is transferred in a heated state by the heating unit, wherein the heating unit includes: a heater case extending in one direction to be arranged in a left and right direction of the evaporator, and having the inlet and the outlet at both sides thereof; and a heater provided with an active heating part accommodated within the heater case and actively generating heat to heat the working fluid, and a passive heating part extending from the active heating part and heated up to
(Continued)

temperature lower than temperature of the active heating part, and wherein the inlet is formed at a position away from the active heating part to prevent the working fluid returned after flowing along the heat pipe from being introduced directly into the active heating part.

7 Claims, 12 Drawing Sheets

(51) Int. Cl.

| | |
|---|---|
| ***F28D 15/02*** | (2006.01) |
| ***F25D 21/08*** | (2006.01) |
| ***F25B 39/02*** | (2006.01) |
| ***F25D 19/00*** | (2006.01) |
| ***F28F 1/32*** | (2006.01) |
| ***F28F 1/28*** | (2006.01) |
| *F28D 1/047* | (2006.01) |
| *F28D 21/00* | (2006.01) |

(52) U.S. Cl.
CPC ..... *F25D 19/006* (2013.01); *F25D 21/08* (2013.01); *F28D 15/0266* (2013.01); *F28D 15/0275* (2013.01); *F28F 1/28* (2013.01); *F28F 1/32* (2013.01); *F25D 19/00* (2013.01); *F25D 2400/02* (2013.01); *F28D 1/047* (2013.01); *F28D 15/025* (2013.01); *F28D 2021/0071* (2013.01); *F28F 2215/04* (2013.01)

(58) Field of Classification Search
CPC ..... F25B 2313/0211; F28D 15/025; F28D 15/0266; F28D 15/0275; F28F 1/28; F28F 1/32
USPC ..... 392/341, 441, 449, 465, 466, 488
See application file for complete search history.

(56) References Cited

FOREIGN PATENT DOCUMENTS

| | | | | | |
|---|---|---|---|---|---|
| JP | 08303932 | A * | 11/1996 | ..... | F25D 21/12 |
| JP | 1996303932 | | 11/1996 | | |
| KR | 10-2003-0006262 | | 1/2003 | | |
| KR | 1020030068931 | | 8/2003 | | |
| KR | 10-2004-0014137 | | 2/2004 | | |
| KR | 10-0469322 | | 2/2005 | | |
| KR | 10-2008-0088807 | | 10/2008 | | |
| KR | 10-1036685 | | 5/2011 | | |
| WO | 2014/102362 | | 7/2014 | | |
| WO | WO-2016064200 | A2 * | 4/2016 | ..... | F25B 47/02 |

OTHER PUBLICATIONS

Extended European Search Report in European Appln. No. 16805958.2, dated Mar. 13, 2019, 7 pages.

* cited by examiner

DEFROSTING DEVICE AND REFRIGERATOR HAVING THE SAME

CROSS REFERENCE TO RELATED APPLICATIONS

This application is a U.S. National Phase Application under 35 U.S.C. § 371 of International Application PCT/KR2016/008433, filed on Aug. 1, 2016, which claims the benefit of Korean Application No. 10-2015-0119087, filed on Aug. 24, 2015, the entire contents of which are hereby incorporated by reference in their entireties.

TECHNICAL FIELD

This specification relates to a defrosting device for removing frost implanted in an evaporator provided in a refrigerating cycle, and a refrigerator having the same.

BACKGROUND ART

An evaporator provided in a refrigerating cycle lowers ambient temperature using cold air generated by circulation of refrigerant that flows along a cooling pipe. During this process, when a temperature difference from the ambient temperature is generated, moisture in the air is condensed and frozen on a surface of the cooling pipe.

As the related art defrosting method for removing frost implanted in an evaporator, a defrosting method using an electric heater is generally used.

Recently, a defroster using a heat pipe as heat generation means has been developed, and related technologies are Korean Registration Patent No. 10-0469322 titled as "Evaporator" and Korean Registration Patent No. 10-1036685 titled as "Loop-type heat pipe using bubble jet."

For a heat pipe-type defroster disclosed in the application "Evaporator," a heating unit is arranged perpendicularly in an up and down direction of the evaporator, and a working fluid is filled merely in a bottom portion of the heating unit. The defroster having the structure can increase an evaporating speed by virtue of fast heating, but poses a risk of overheating a heater provided in the heating unit.

A heat pipe-type defroster disclosed in the application "Loop-type heat pipe using bubble jet" has a U-like tube connected to an upper portion of a heating unit. For this defroster having this structure, both end portions of the U-like tube are connected to an upper side of the heating unit, such that a heated working fluid flows up through the both end portions of the tube. This makes it difficult to form a circulation loop.

Also, these structures are involved in a potential backflow of the working fluid, and fail to disclose an internal structure of a heating unit for allowing an efficient circulation of refrigerant.

DISCLOSURE OF THE INVENTION

Therefore, an aspect of the detailed description is to provide a defrosting device with a heating unit capable of safely operating without being overheated.

Another aspect of the detailed description is to provide a defrosting device capable of smoothly defrosting a lower cooling pipe of an evaporator.

Another aspect of the detailed description is to provide a defrosting device capable of efficiently circulating a working fluid.

To achieve these and other advantages and in accordance with the purpose of this specification, as embodied and broadly described herein, there is provided a defrosting device, including a heating unit provided at a lower portion of the evaporator, and a heat pipe connected to an inlet and an outlet of the heating unit, respectively, and having at least part thereof disposed adjacent to a cooling pipe of the evaporator such that the cooling pipe of the evaporator is heated by a working fluid of high temperature which is transferred in a heated state by the heating unit, wherein the heating unit includes a heater case extending in one direction to be arranged in a left and right direction of the evaporator, and having the inlet and the outlet at both sides thereof, and a heater provided with an active heating part accommodated within the heater case and actively generating heat to heat the working fluid, and a passive heating part extending from the active heating part and heated up to temperature lower than temperature of the active heating part.

The present invention discloses various configurations, as follows, in order to provide a defrosting device in which the heating unit can safely operate without being overheated.

First, the working fluid filled in the heater case may be filled high enough that a surface thereof is located higher than an upper end portion of the heater in a liquid state. That is, the heater may be soaked below the surface of the working fluid.

Meanwhile, the inlet may be formed at a position away from the active heating part to prevent the working fluid returned after flowing along the heat pipe from being introduced directly into the active heating part.

As one example, the inlet may be formed at a position, facing the passive heating part, on an outer circumferential surface of the heater case such that the returned working fluid is introduced into a space between the heater case and the passive heating part.

In the example, when the heat pipe includes a first heat pipe and a second heat pipe arranged on a front portion and a rear portion of the evaporator into two rows, the inlet may include a first inlet and a second inlet formed on both sides of the outer circumference of the heater case with interposing the passive heating part therebetween, and the first and second heat pipes may be connected to first and second return pipes extending from the first and second inlets, respectively.

In the example, a rear end portion of the passive heating part may be externally exposed at a rear end of the heater case.

In the example, the outlet may be formed at a position backwardly spaced apart from a front end of the heater case with a predetermined interval, to prevent overheating of the active heating part resulting from some of the working fluid gathered in a front end portion of the heater case. The outlet may preferably be formed such that a center thereof is located at a position spaced apart by 15 mm from an inner front end of the heater case.

As another example, an inner space of the heater case corresponding to the inlet may be left empty. In this example, the active heating part may be arranged between the inlet and the outlet of the heater case, and the passive heating part may extend from a front side of the active heating part and be arranged to correspond to the outlet of the heater case.

In the another example, a front end portion of the passive heating part may be externally exposed at a front end of the heater case.

In the another example, the heat pipe may include a perpendicular extending portion extending to an upper side of the evaporator such that the working fluid heated by the heating unit flows upward, and a heat sink portion extending from the perpendicular extending portion into a zigzag shape along the cooling pipe of the evaporator. The heating unit may further include an outlet pipe provided with a first extending portion upwardly inclined from the outlet toward an outside of the evaporator, and a second extending portion bent from the first extending portion and connected to the perpendicular extending portion.

In the another example, when the heat pipe includes a first heat pipe and a second heat pipe arranged on a front portion and a rear portion of the evaporator into two rows, the outlet may include a first outlet and a second outlet formed on both sides of an outer circumference of the heater case with interposing the passive heating part therebetween, and the first and second heat pipes may be connected to first and second outlet pipes extending from the first and second outlets, respectively.

The present invention discloses the following configurations, in order to provide a defrosting device capable of smoothly defrosting a lower cooling pipe of the evaporator.

The heat pipe may include a horizontal extending portion arranged at a lower portion of the evaporator in a left and right direction and connected to the heating unit such that the working fluid heated by the heating unit is supplied, a perpendicular extending portion connected to the horizontal extending portion and extending to an upper side of the evaporator such that the heated working fluid flows upward, and a heat sink portion extending from the perpendicular extending portion into a zigzag shape along the cooling pipe of the evaporator.

The present invention discloses the following configurations, in order to provide a defrosting device capable of efficiently circulating the working fluid.

The heating unit may further include a return pipe extending from the inlet and connected to the heat pipe, and an inner diameter of the return pipe may be greater than 5 mm and smaller than 7 mm. The inner diameter of the return pipe may preferably be 6.35 mm.

The heat pipe may include a perpendicular extending portion extending to an upper side of the evaporator such that the working fluid heated by the heating unit flows upward, and a heat sink portion extending from the perpendicular extending portion into a zigzag shape along the cooling pipe of the evaporator. The heating unit may further include an outlet pipe upwardly extending from the outlet to be connected to the perpendicular extending portion.

Here, the heating unit may be arranged at the same height as the lowermost row of the cooling pipe, or arranged at a position lower than the lowermost row of the cooling pipe.

The heating unit may be arranged at the lower portion of the evaporator in a left and right direction, and the outlet may be formed at a position higher than the inlet.

The heating unit may be upwardly inclined such that one side thereof with the outlet is located higher than another side with the inlet.

Advantageous Effect

In accordance with the detailed description, a heating unit may be arranged at a lower portion of an evaporator in a left and right direction and a heater may be soaked below a surface of a working fluid when the working fluid is fully in a liquid state. This may allow a safe defrosting operation without overheating the heating unit.

Here, an outlet of the heating unit may be formed at a position backwardly spaced apart from a front end of a heater case with a predetermined interval. Accordingly, some of the working fluid may be gathered in a front end portion of the heater case to prevent an active heating part from being overheated.

With the structure, when a horizontal extending portion is connected to an outlet pipe of the heating unit, the working fluid of high temperature may flow along the lower portion of the evaporator, which may facilitate the defrosting of a lower cooling pipe of the evaporator.

Also, with the structure, an inlet of the heating unit may communicate with a space between a passive heating part and the heater case or with an empty space within the heating unit. This instance can generate a series of flow of the working fluid F in a manner that a returned working fluid may flow through the passive heating part of relatively low temperature or the empty space without being introduced directly into the active heating part, reheated by the active heating part, and then discharged through the outlet. This may result in preventing a backflow of the working fluid.

In addition, a return pipe having an inner diameter greater than 5 mm and smaller than 7 mm can be used as a return pipe connected to the inlet of the heating unit. In this instance, the returned working fluid can smoothly be introduced into the heater case, and the backflow of the reheated working fluid can be prevented.

Also, the outlet of the heating unit can be located higher than the inlet, which may result in smoothly generating the flow of the working fluid which is reheated by the heater and then discharged in a gaseous state with a lift force.

MODES FOR CARRYING OUT THE PREFERRED EMBODIMENTS

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated.

Figure 1:
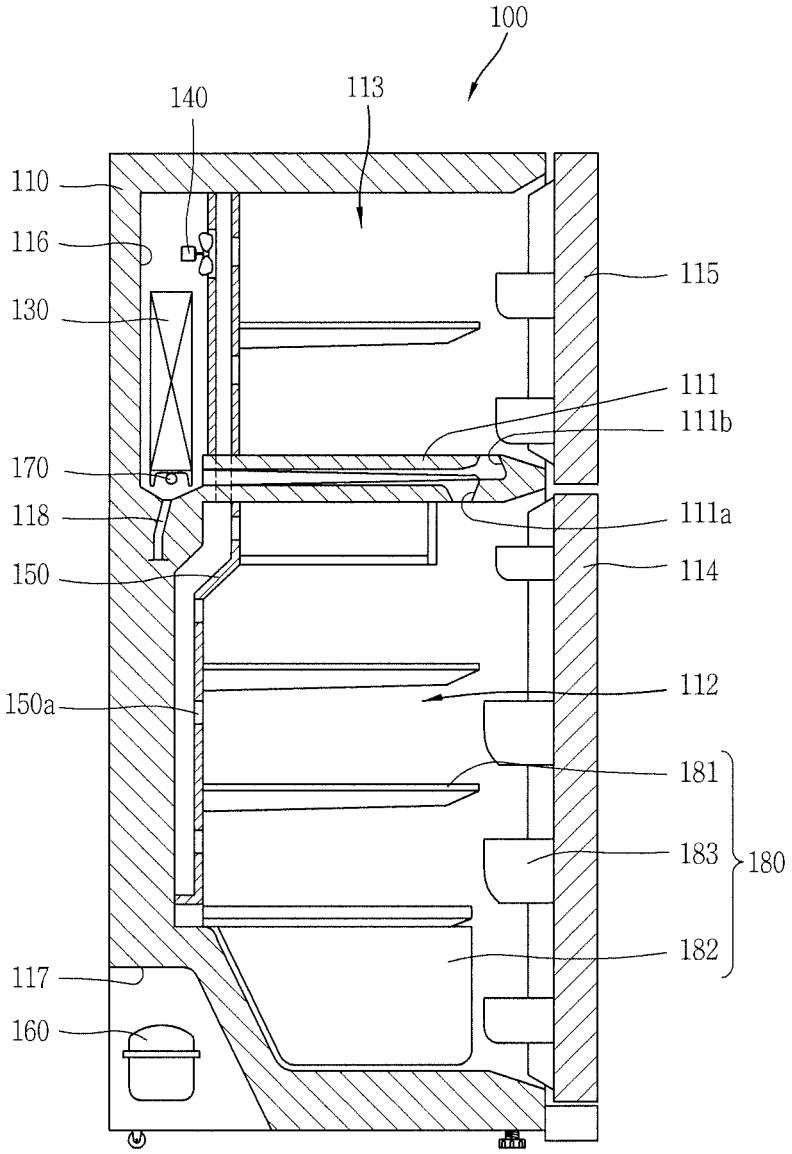
FIG. 1 is a longitudinal sectional view schematically illustrating a configuration of a refrigerator in accordance with one embodiment of the present invention.

FIG. 1 is a longitudinal sectional view schematically illustrating a configuration of a refrigerator 100 in accordance with one embodiment of the present invention.

A refrigerator 100 is an apparatus for keeping foods stored therein in a cool and fresh state using cold air generated by a refrigerating cycle in which processes of compression-condensation-expansion-evaporation are continuously executed.

As illustrated in FIG. 1, a refrigerator main body 110 has a storage space for storing foods therein. The storage space may be divided by a partition wall 111 into a refrigerating chamber 112 and a freezing chamber 113 according to a set temperature.

This embodiment illustrates a top mount type refrigerator having the freezing chamber 113 above the refrigerating chamber 112, but the present invention may not be limited to this. This embodiment may alternatively be applied to a side by side type refrigerator having a refrigerating chamber and a freezing chamber arranged side by side, and a bottom freezer type refrigerator having a refrigerating chamber above a freezing chamber.

A door is connected to the refrigerator main body 110 to open and close a front opening of the refrigerator main body 110. FIG. 1 illustrates that a refrigerating chamber door 114 and a freezing chamber door 115 are provided to open and close front portions of the refrigerating chamber 112 and the freezing chamber 113, respectively. The door may be implemented into various types, such as a rotatable door connected to the refrigerator main body 110 in a rotatable manner, a drawer-type door connected to the refrigerator main body 110 in a slidable manner, and the like.

The refrigerator main body 110 is provided with at least one accommodating unit 180 (e.g., a shelf 181, a tray 182, a basket 183, etc.) for efficiently using an internal storage space thereof. For example, the shelf 181 and the tray 182 may be disposed within the refrigerator main body 110, and the basket 183 may be disposed on an inner side of the door 114 connected to the refrigerator main body 110.

Meanwhile, a cooling chamber 116 having an evaporator 130 and a blowing fan 140 is provided in a rear area of the freezing chamber 113. A refrigerating chamber return duct 111*a* and a freezing chamber return duct 111*b* are disposed through the partition wall 111 such that air of the refrigerating chamber 112 and the freezing chamber 113 can be introduced and flow back into the cooling chamber 116. Also, a cold air duct 150 that communicates with the freezing chamber 113 and has a plurality of cold air discharge openings 150*a* formed through a front surface thereof is disposed in a rear area of the refrigerating chamber 112.

A machine room 117 is disposed in a bottom portion of a rear area of the refrigerator main body 110, and a compressor 160, a condenser (not illustrated) and the like are disposed within the machine room 117.

Meanwhile, the blowing fan 140 of the cooling chamber 116 allows air within the refrigerating chamber 112 and the freezing chamber 113 to be introduced into the cooling chamber 116 through the refrigerating chamber return duct 111*a* and the freezing chamber return duct 111*b* of the partition wall 111. The introduced air exchanges heat with the evaporator 130. The heat-exchanged air is then discharged into the refrigerating chamber 112 and the freezing chamber 113 through the cold air discharge openings 150*a* of the cold air duct 150. This series of processes is repetitively executed. In this instance, frost is implanted on a surface of the evaporator 130 due to a temperature difference from circulating air that is re-introduced through the refrigerating chamber return duct 111*a* and the freezing chamber return duct 111*b*.

To remove the frost, a defrosting device 170 is provided at the evaporator 130. Water removed by the defrosting device 170, namely, defrosted water is collected in a defrosted water tray (not illustrated) below the refrigerator main body 110 through a defrosted water discharge pipe 118.

Hereinafter, a new type of defrosting device 170 capable of reducing power consumption and increasing heat exchange efficiency during defrosting will be described.

Figure 2:
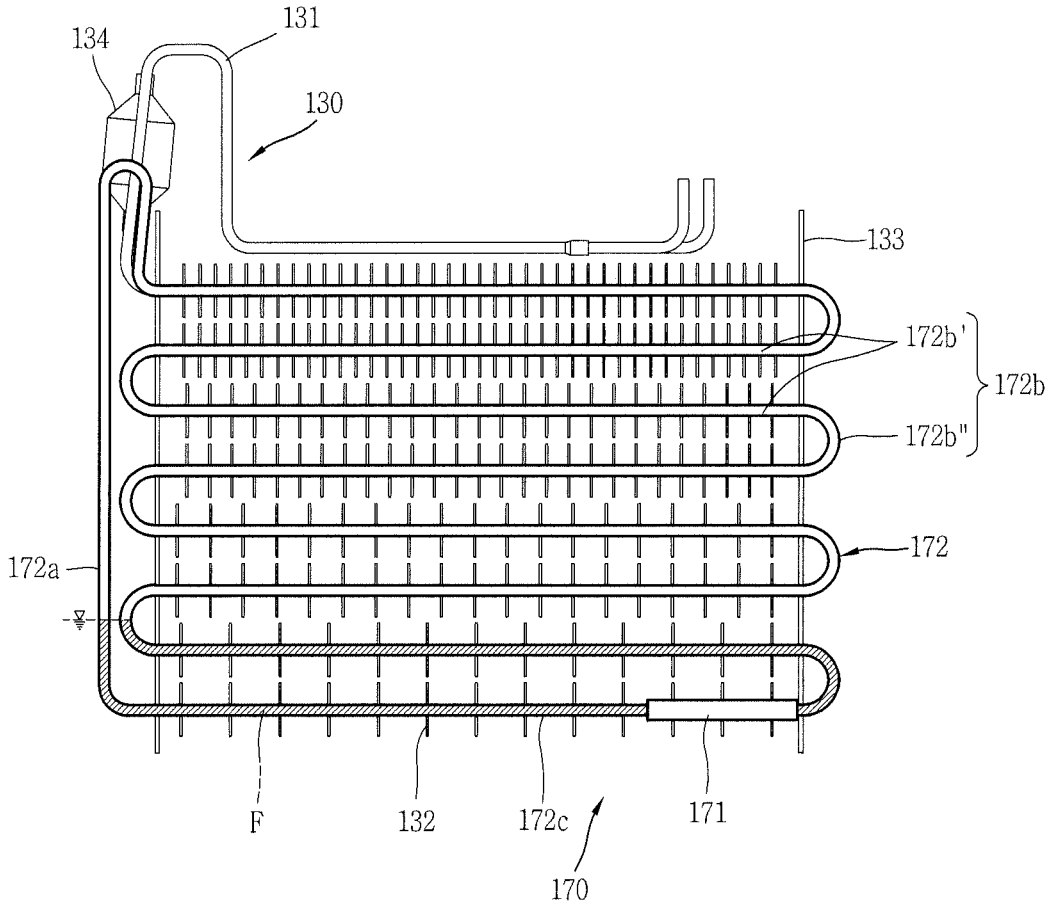
FIG. 2 is a conceptual view illustrating the one embodiment of the defrosting device applied to FIG. 1.
Figure 3:
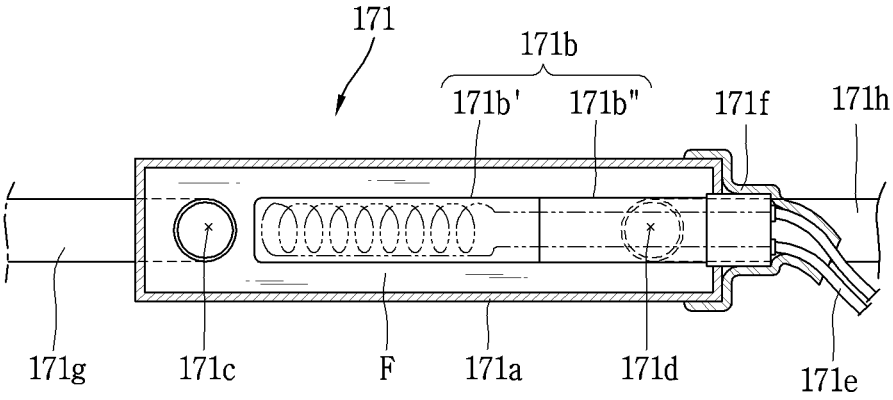
FIG. 3 is a sectional view of a heating unit illustrated in FIG. 2.

FIG. 2 is a conceptual view illustrating the one embodiment of the defrosting device 170 applied to FIG. 1, and FIG. 3 is a sectional view of a heating unit 171 illustrated in FIG. 2.

As illustrated in FIGS. 2 and 3, the evaporator 130 includes a cooling pipe 131, a plurality of cooling fins 132, and a plurality of supporters 133.

The cooling pipe 131 is repetitively bent into a zigzag shape to form plural steps (columns) and filled with refrigerant therein. The cooling pipe 131 may be configured by combination of horizontal piping portions and bent piping portions. The horizontal piping portions are horizontally arranged in an up and down direction and penetrate through cooling fins 132. Each of the bent piping portions connects an end portion of an upper horizontal piping portion to an end portion of a lower horizontal piping portion in a communicating manner.

Meanwhile, the cooling pipe 131 may alternatively be configured to form a single row or a plurality of rows in a back and forth direction of the evaporator 130.

For reference, FIG. 2 illustrates a heat pipe 172 formed in a shape corresponding to the cooling pipe 131, which will be explained later. Accordingly, the cooling pipe 131 is partially obscured by the heat pipe 172. However, the present invention may not be limited to this. For example, the heat pipe 172 may be arranged between adjacent rows of the cooling pipe 131.

The cooling pipe 131 is provided with the plurality of cooling fins 132 that are arranged with being spaced apart from one another with predetermined intervals in an extending direction of the cooling pipe 131. The cooling fin 132 may be formed in a shape of a flat plate made of an aluminum material. The cooling pipe 131 may extend in diameter in an inserted state into an insertion hole of the cooling fin 132, thereby being firmly inserted in the insertion hole.

The plurality of supporters 133 are provided at both sides of the evaporator 130, and each extends perpendicularly in an up and down direction to support bent end portions of the cooling pipe 131. Each of the plurality of supporters 133 is provided with an insertion recess in which the heat pipe 172 is fixedly inserted.

The defrosting device 170 is configured to remove frost generated on the evaporator 130, and as illustrated, is installed on the evaporator 130. The defrosting device 170 includes a heating unit 171, and a heat pipe 172.

The heating unit 171 is located at a lower portion of the evaporator 130 and electrically connected to a controller (not illustrated). When a driving signal is received from the controller, the heating unit 171 generates heat. For example, the controller may apply the driving signal to the heating unit 171 at a preset time interval, or when a detected temperature of the cooling chamber 116 is lowered below a preset temperature.

Explaining the heating unit 171 in detail with reference to FIG. 3, the heating unit 171 includes a heater case 171*a* and a heater 171*b*.

The heater case 171*a* extends in one direction and is arranged at the lower portion of the evaporator 130 in a left and right direction. The heater case 171*a* may be formed in a cylindrical or square pillar shape.

The heater case 171*a* may be arranged at the same height as the lowermost step of the cooling pipe 131 or at a position lower than the lowermost step of the cooling pipe 131. Also, the heater case 171*a* may be arranged at one side of the evaporator 130 where an accumulator 134 is located, at another side opposite to the one side, or at an arbitrary point between the one side and the another side.

This conceptual view illustrates that the heater case 171*a* is arranged at the another side of the evaporator 130 at the same height as the lowermost step of the cooling pipe 131 in parallel to the cooling pipe 131 in a horizontal direction of the evaporator 130.

The heater case 171*a* is connected to both end portions of the heater pipe 172 to form a passage in a closed-loop shape together with the heat pipe 172, such that a working fluid F can circulate along the passage.

An outlet 171*c* and an inlet 171*d* that are connected to the both end portions of the heat pipe 172, respectively, are formed on both sides of the heater case 171*a* in a left and right direction of the heater case 171*a*.

In detail, the outlet 171*c* that communicates with an outlet pipe 171*g* (or one end portion of the heat pipe 172), which will be explained later, is formed on one side of the heater case 171*a* (e.g., a front surface of the heater case 171*a* or an outer circumferential surface adjacent to the front surface). The outlet 171*c* refers to an opening through which an evaporated working fluid F is discharged into the heat pipe 172.

The inlet 171*d* that communicates with a return pipe 171*h* (or another end portion of the heat pipe 172), which will be explained later, is formed on another side of the heater case 171*a* (e.g., a rear surface of the heater case 117*a* or an outer circumferential surface adjacent to the rear surface). The inlet 171*d* refers to an opening through which a working fluid F condensed while flowing along the heat pipe 172 is returned to the heating unit 171.

The heater 171*b* is accommodated in the heater case 171*a*, and has a shape extending in a lengthwise direction of the heater case 171*a*. This conceptual view illustrates that the heater 171*b* is arranged in parallel to the evaporator 130 in a left and right direction of the evaporator 130.

The heater 171*b* may be fixed to the heater case 171*a* by being inserted through another side of the heater case 171*a*. That is, a rear end of the heater 171*b* may be fixedly sealed on a rear end portion of the heater case 171*a*, and a front end of the heater 171*b* may extend toward a front end portion of the heater case 171*a*.

The heater 171*b* is arranged by being spaced apart from an inner circumferential surface of the heater case 171*a* with a preset interval. According to the arrangement, an annular space having a gap in an annular shape is formed between an inner circumferential surface of the heater case 171*a* and an outer circumferential surface of the heater 171*b*.

A lead wire 171*e* is provided within the heater 171*b* such that the heater 171*b* can generate heat in response when power is applied. A portion of the heater 171*b* wound with the lead wire plural times constructs an active heating part 171*b*' that is heated up to high temperature to evaporate a working fluid. The active heating part 171*b*' will be explained later.

The heat pipe 172 is connected to the outlet 171*c* provided at a left side of the heating unit 171 and the outlet 171*d* provided at a right side of the heating unit 171, respectively, and filled therein with a predetermined working fluid F. A general refrigerant (e.g., R134a, R-600a, etc.) may be used as the working fluid F.

At least part of the heat pump 172 is disposed adjacent to the cooling pipe 131 of the evaporator 130 and thus transfers heat to the cooling pipe 131 of the evaporator 130 by the working fluid F of high temperature, which is transferred after heated by the heating unit 171, which facilitates defrosting of the evaporator 130.

As the working fluid F filled in the heat pipe 172 is heated up to high temperature by the heating unit 171, the working fluid F flows along the heat pipe 172 by a pressure difference. In detail, the hot working fluid F which has been heated by the heater 171*b* and discharged through the outlet 171*c* transfers heat to the cooling pipe 131 of the evaporator 130 while flowing along the heat pipe 172. The working fluid F is gradually cooled while the heat-exchange is executed and then introduced into the inlet 171*d*. The cooled working fluid F is reheated by the heater 171*b* and then discharged again through the outlet 171*c*. This series of processes is repetitively executed. The defrosting for the cooling pipe 131 is realized in such circulating manner.

The heat pipe 172, similar to the cooling pipe 131, may have a shape (zigzag shape) bent in a repetitive manner. To this end, the heat pipe 172 includes a perpendicular extending portion 172*a* and a heat sink portion 172*b*, and may further include a horizontal extending portion 172*c*, if necessary.

The perpendicular extending portion 172*a* extends to an upper portion of the evaporator 130 such that the working fluid F heated by the heating unit 171 flows upward. The perpendicular extending portion 172*a* extends up to the upper portion of the evaporator 130 in a state of being arranged at an outer side of one of the supporters 133 with a predetermined spaced distance in parallel to the supporter 133.

The heat sink portion 172*b* is connected to the perpendicular extending portion 172*a*, and extends into a zigzag shape along the cooling pipe 131 of the evaporator 130. The heat sink portion 172*b* is configured by combination of a plurality of horizontal pipes 172*b*' arranged in steps, and connection pipes 172*b*" each formed in a U-like shape bent to connect the adjacent horizontal pipes 172*b*' in the zigzag shape.

The perpendicular extending portion 172*a* or the heat sink portion 172*b* may extend up to a position adjacent to the accumulator 134 to remove frost implanted on the accumulator 134.

As illustrated, when the perpendicular extending portion 172*a* is arranged at one side of the evaporator 130 where the accumulator 134 is located, the perpendicular extending portion 172*a* may extend up to a location adjacent to the accumulator 134 and extend down toward the cooling pipe 131 in a bent manner, so as to be connected to the heat sink portion 172*b*.

On the other hand, when the perpendicular extending portion 172*a* is arranged at another side, opposite to the one side, the heat sink portion 172*b* may horizontally extend in a connected state with the perpendicular extending portion 172*a*, extend up toward the accumulator 134, and then extend down toward the cooling pipe 131 in the bent manner.

Meanwhile, the heat pipe 172 may further include a horizontal extending portion 172*c* according to an installation position of the heating unit 171. As one example, when the heating unit 171 is provided at a spaced position from the perpendicular extending portion 172*a*, the horizontal extending portion 172*c* for connecting the heating unit 171 and the perpendicular extending portion 172*a* to each other may further be provided.

When the horizontal extending portion 172*c* is connected to the heating unit 171, the hot working fluid F may flow through a lower portion of the evaporator 130, thereby enabling smooth defrosting for the lower cooling pipe 131 of the evaporator 130.

As such, the heating unit 171 is connected to the horizontal extending portion 172*c* or the perpendicular extending portion 172*a* so as to supply the heated working fluid F into the heat pipe 172. Explaining the connecting structure in detail, the heating unit 171 further includes an outlet pipe 171*g* extending from the outlet 171*c* and connected to the heat pipe 172, in detail, to the horizontal extending portion 172*c* or the perpendicular extending portion 172*a*.

Also, the heating unit 171 is connected to the heat sink portion 172*b* such that the working fluid F cooled by the heat-exchange with the cooling pipe 131 while flowing along the heat pipe 172 can be returned. Explaining the connecting structure in detail, the heating unit 171 further includes a return pipe 171*h* that extends from the inlet 171*d* to be connected to the heat sink portion 172*b* of the heat pipe 172.

In the structure that the heating unit 171 is disposed at one side of the evaporator 130 and the horizontal extending portions 172 for connection with the perpendicular extending portion 172*a* is provided, an end portion of the heat sink portion 172*b* connected to the return pipe 171*h* may be formed in a bent shape. This conceptual view exemplarily illustrates that the end portion of the heat sink portion 172*b* is bent into a U-like shape With the structure, the flowing direction of a returned working fluid F is turned at least one time just before the working fluid F is introduced into the return pipe 171*h*. Here, since great flow resistance is generated at the bent portion, a backflow of the returned working fluid F can be prevented.

According to this conceptual view, the working fluid F heated by the heater 171*b* is introduced into the horizontal extending portion 172*c* through the outlet pipe 171*g*, and transferred to the upper portion of the evaporator 130 through the perpendicular extending portion 172*a*. The transferred working fluid F transfers heat to the cooling pipe 130 while flowing along the heat sink portion 172*b*, such that the cooling pipe 130 is defrosted. The working fluid F used for the defrosting returns through the return pipe 171*h*, re-heated by the heater 171*b* and then flows along the heat pipe 172. In this manner, the working fluid F forms a circulation loop.

As described above, the heater 171*b* is accommodated within the heater case 171*a* and extends along the lengthwise direction of the heater case 171*a*. Also, the heating unit 171 and the heat pipe 172 are filled with a predetermined amount of the working fluid F.

In a liquid state of the working fluid F (i.e., in a non-operating state of the heater 171*b*), when an upper end portion of the heater 171*b* is exposed above a surface of the working fluid F, the upper end portion of the heater 171*b* drastically increases in temperature, unlike the other portion soaked in the working fluid F once the heater 171*b* operates.

When this state is maintained, the upper end portion of the heater 171*b* may be overheated to cause a fatal damage on the defrosting device 170, and also the heated working fluid F may flow back into another end portion of the heat pipe 172, into which the returned working fluid F should be introduced.

To prevent this, the working fluid F is filled in the heater case 171*a* in a manner that a surface thereof is located higher than the upper end portion of the heater 171*b* in the liquid state. That is, the heater 171*b* is configured to be soaked below the surface of the working fluid F.

With the configuration, since the heater 171*b* is heated in the soaked state below the surface of the working fluid F in the liquid state, the working fluid F which has been evaporated due to being heated may sequentially be transferred into the heat pipe 172. This may result in a smooth circulating flow and a prevention of the overheat of the heating unit 171.

This conceptual view exemplarily illustrates that the working fluid F is filled from the lowermost-step horizontal pipe of the heat pipe 172 up to a first horizontal pipe (i.e., up to the second horizontal pipe from bottom) when the working fluid F is in the liquid state. The working fluid F is filled as much as the heater 171*b* being soaked, and a filling amount of the working fluid F should approximately be selected by considering heat sink temperature of each step of the heat pipe 172 according to a filling amount to a total volume of the heat pipe 172.

Meanwhile, referring to FIG. 3, the heater 171*b* may be divided into an active heating part 171*b*' and a passive heating part 171*b*" according to whether or not heat generation is actively executed.

In detail, the active heating part 171*b*' is configured to actively generate heat. The working fluid F in the liquid state may be heated by the active heating part 171*b*' so as to be changed in phase into a gaseous state of high temperature.

The output 171*c* of the heating unit 171 is located to correspond to the active heating part 171*b*' or located at a position ahead the active heating part 171*b*'. FIG. 3 exemplarily illustrates that the outlet 171*c* of the heating unit 171 is formed on an outer circumference of the heater case 171*a* at the front of the active heating part 171*b*'.

Here, the outlet 171*c* may be formed at a position backwardly spaced apart from a front end of the heater case 171*a* with a predetermined interval. In this instance, a predetermined amount of working fluid F is gathered with forming a vortex at the front end portion of the heater case 171*a*, thereby preventing the overheat of the active heating part 171*b*'.

According to test results, it has been noticed that the working fluid F is entirely discharged through the outlet 171*c* and overheated when the outlet 171*c* is formed on the front surface of the heater case 171*a* (i.e., when a distance between the front end of the heater case 171*a* and the outlet 171*c* is 0 mm), whereas a considerable amount of the working fluid F is gathered with forming the vortex at the front end portion of the heater case 171*a* without being smoothly discharged through the outlet 171*c* when the outlet is formed apart by 20 mm from the front end of the heater case 171*a*.

Considering the overheat of the heater 171*b* and the smooth discharge of the working fluid F, the outlet 171*c* is preferably formed in a manner that a center thereof is located at a position spaced apart by 15 mm from an inner front end of the heater case 171*a*.

The passive heating part 171*b*" is disposed at one side of the active heating part 171*b*'. The passive heating part 171*b*" does not generate heat by itself, unlike the active heating part 171*b*', but is heated up to a predetermined temperature by receiving heat generated by the active heating part 171*b*'.

Here, the passive heating part 171*b*" merely causes a predetermined temperature increase of the liquid working fluid F, but does not have temperature high enough to cause the phase change of the working fluid F into the gaseous state.

Explaining the heater 171*b* from the temperature perspective, the active heating part 171*b*' forms a relatively high temperature portion, and the passive heating part 171*b*" forms a relatively low temperature portion.

In detail, the lead wire 171*e* is inserted into the heater 171*b* and wound plural times therein, to generate heat of high temperature upon applying power. As such, a portion of the heater 171*b* in which the lead wire 171*e* is wound plural times constructs the active heating part 171*b*'. Also, a portion, through which the lead wire 171*e* passes, at one side of the active heating part 171*b*' is filled with an insulating material, so as to construct the passive heating part 171*b*". The insulating material may be magnesium oxide, for example.

In a structure that the working fluid F returns directly to the active heating part 171*b*' of high temperature within the heating unit 171, the returned working fluid F may be re-heated and thereby flow backward without smoothly returning into the heating unit 171. This may interfere with the circulating flow of the working fluid F within the heat pipe 172 and thereby cause a problem of overheating the heating unit 171, more particularly, the entire heat pipe 172.

To overcome this problem, the inlet 171*d* of the heating unit 171 is formed at a position away from the active heating part 171*b*'. This may prevent the working fluid F returned after flowing along the heat pipe 172 from being introduced directly into the active heating part 171*b*'.

As one related embodiment, this conceptual view illustrates that the inlet 171*d* of the heating unit 171 is located to correspond to the passive heating part 171*b*" such that the working fluid F returned after flowing along the heat pipe 172 is introduced into a space between the heater case 171*a* and the passive heating part 171*b*". The inlet 171*d* of the heating unit 171 may be formed on an outer circumference of a portion of the heater case 171*a*, which surrounds the passive heating part 171*b*".

Here, a rear end portion of the passive heating part 171*b*" is externally exposed at the rear end of the heater case 171*a*. The passive heating part 171*b*" exposed outside the heater case 171*a* externally discharges heat of the heater 171*b*, thereby lowering a surface load of the heater 171*b*. When the surface load of the heater 171*b* is lowered, the overheat of the heater 171*b* can be prevented and thus reliability of the heater 171*b* can be ensured, resulting in extending the lifespan of the heater 171*b*.

Meanwhile, the externally-exposed rear end portion of the passive heating part 171*b*" and the lead wire 171*e* may be covered by a heat-shrinkable tube 171*f*.

In the mean time, an inner diameter of the return pipe 171*h* is associated with a return amount, a backflow and the like of the working fluid F, and thus affects temperatures of the heating unit 171 and the heat pipe 172. Hereinafter, a proper inner diameter of the inlet 171*d* of the return pipe 171*h* for a normal operation of the defrosting device 170 will be described.

Figure 4A:
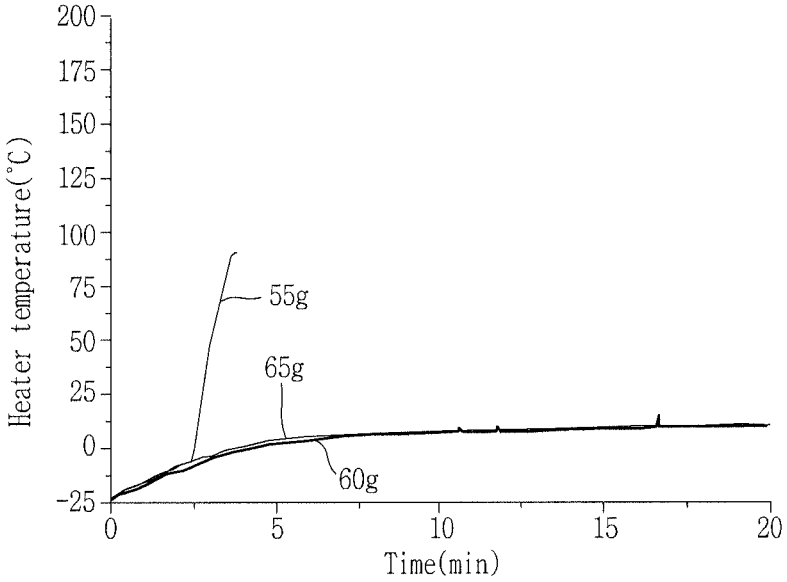
FIGS. 4A to 4C are graphs showing temperature changes of a heater based on an inner diameter of a return pipe illustrated in FIG. 3 under a freezing condition.
Figure 4B:
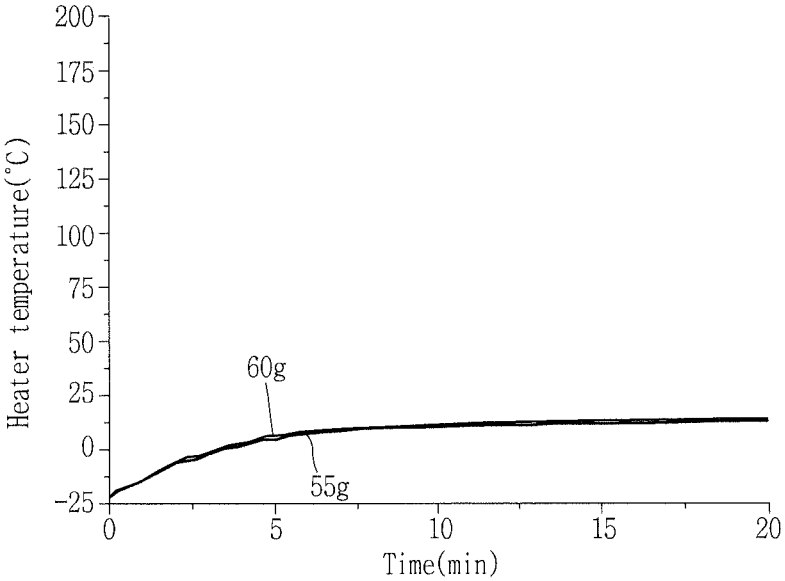
Figure 4C:
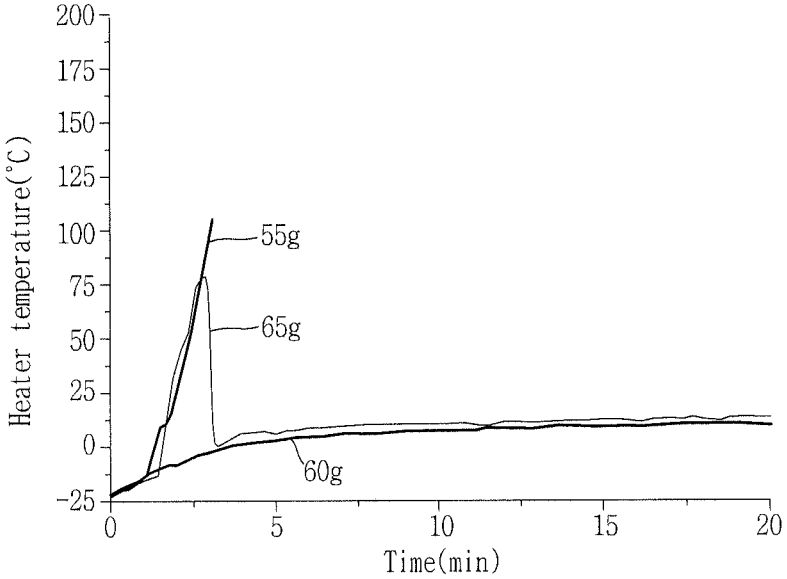

FIGS. 4A to 4C are graphs showing temperature changes of the heater 171*b* according to the inner diameter of the return pipe 171*h* illustrated in FIG. 3 under a freezing condition.

FIG. 4A illustrates a case where the inner diameter of the return pipe 171*h* is 4.75 mm, FIG. 4B illustrates a case where the inner diameter of the return pipe 171*h* is 6.35 mm, and FIG. 4C illustrates a case where the inner diameter of the return pipe 171*h* is 7.92 mm. In this test, the temperature changes of the heater 171*b* according to the inner diameter of the return pipe 171*h* have been measured by setting an appropriate amount of the working fluid F to 55 g, 60 g and 65 g, respectively.

As illustrated in FIG. 4A, in case where the inner diameter of the return pipe 171*h* is 4.75 mm, the heater 171*b* has been overheated when the amount of the working fluid F is 55 g. It is determined that this results from that an amount of the working fluid F returning to the heating unit 171 is reduced, as compared with an appropriate amount, due to a narrow diameter of the return pipe 171*h*. Accordingly, the working fluid F cannot sufficiently be brought into contact with the heater 171*b* which the heater 171*h* operates. As such, when the diameter of the return pipe 171*b* is less than 5 mm, a surface temperature of the heater 171*b* may increase and thereby a part of the heater 171*b* may be likely to be overheated (a phenomenon of emitting surface temperature).

As illustrated in FIG. 4C, in case where the inner diameter of the return pipe 171*h* is 7.92 mm, the heater 171*b* has been overheated when the amount of the working fluid F is 55 g and 65 g, respectively. As such, when the diameter of the return pipe 171*h* is more than 7 mm, the working fluid F has not been returned to the heating unit 171 with being fully filled in the return pipe 171*h*, but introduced into the heating unit 171 with a space generated at an upper portion within the return pipe 171*h*. In this instance, the working fluid F introduced into the heating unit 171 is heated by the heater 171*b* and strongly flows within the heating unit 171. During this, some of the working fluid F are discharged to the upper space of the return pipe 171*h* and eventually flows back into the return pipe 171*h*.

As such, such phenomenon is generated due to the change in the inner diameter of the return pipe 171*h*. Therefore, to prevent the overheat of the heater 171*b* and the backflow of the working fluid F, the inlet 171*d* should be located at the position away from the active heating part 171*b*' and additionally the return pipe 171*h* having an appropriate inner diameter should be used.

As illustrated in FIG. 4B, it has been noticed that the heating unit 171 is not overheated when the inner diameter of the return pipe 171*h* is 6.35 mm. This means that the working fluid F can smoothly return and be re-heated in a circulating manner. For reference, the amounts of the working fluid F used for this test are 55 g and 60 g, respectively, and these amounts are filling amounts corresponding to 30 to 35% of a total volume of the heat pipe 172.

As aforementioned, the inner diameter of the return pipe 171*h* may be formed greater than 5 mm and smaller than 7 mm. Preferably, a commercial pipe having an inner diameter of 6.35 mm within the range may be used as the return pipe 171*h*.

The test has used the heater case 171*a* having the inner diameter of 11.1 mm. The specification of the heater case 171*a* may slightly differ from the specification used in the test, but a return pipe having the above inner diameter condition may equally be used as the return pipe 171*h*.

Meanwhile, when the heater 171*b* installed within the heating unit 171 is heated, air bubbles may be generated on the surface of the heater 171*h* according to the state of the working fluid F, which may evolve into an air layer with a predetermined size. This is typically referred to as film boiling.

When the heating unit 171 is horizontally arranged at the lower portion the evaporator, similar pressure may sometimes be generated at both sides of the position where the film boiling occurs. In this instance, the air layer on the surface of the heater 171*b* at the position may further be improved to the degree of dividing both sides within the heating unit 171. In this instance, the air layer by the film boiling obstructs the flow of the working fluid F within the heating unit 171, which results in interfering with the continuous circulation of the heated working fluid F within the heat pipe 172.

Hereinafter, various structures allowing a smooth flow of the working fluid even though the film boiling occurs within the heating unit 171 will be described.

FIGS. 5 to 8 are conceptual views illustrating variations of heating units 271, 371, 471 and 571 applied to the defrosting device 170 of FIG. 3.

In the variations illustrated in FIGS. 5 to 7, description will be given under assumption that the heating unit 271, 371, 471, 571 is arranged in parallel at the lower portion of the evaporator 130. That is, the variations illustrate formation positions of an inlet 271*d*, 371*d*, 471*d*, 571*d* and an outlet 271*c*, 371*c*, 471*c*, 571*c* for allowing the smooth flow of the working fluid F even though the heating unit 271, 371. 471, 571 is arranged in parallel at the lower portion the evaporator 130.

These variations may not be limited to the horizontal arrangement of the heating unit 271, 371, 471, 571. The heating unit 271, 371, 471, 571 may be arranged to be upwardly inclined such that one side thereof with the outlet 271*c*, 371*c*, 471*c*, 571*c* is higher than another side with the inlet 271*d*, 371*d*, 471*d*, 571*d*.

In these variations, the outlet 271*c*, 371*c*, 471*c*, 571*c* of the heating unit 271, 371, 471, 571 is located to correspond to an active heating part 271*b*', 371*b*', 4711Y, 571*b*' or located ahead the active heating part 271*b*', 371*b*', 471*b*', 571*b*'. FIGS. 5 to 8 exemplarily illustrate that the outlet 271*c*, 371*c*, 471*c*, 571*c* of the heating unit 271, 371, 471, 571 is formed on an outer circumference of a heater case 271*a*, 371*a*, 471*a*, 571*a* at the front of the active heating part 271*b*', 371*b*', 471*b*', 571*b*'.

Also, the inlet 271*d*, 371*d*, 471*d*, 571*d* of the heating unit 271, 371, 471, 571 is located at a position away from the active heating part 271*b*', 371*b*', 471*b*', 571*b*', such that the working fluid F returned after flowing along a heat pipe 272, 372, 472, 572 cannot be introduced directly into the active heating part 271*b*', 371*b*', 471*b*', 571*b*'. FIGS. 5 to 8 illustrate that the inlet 271*d*, 371*d*, 471*d*, 571*d* of the heating unit 271, 371, 471, 571 is located to correspond to a passive heating part 271*b*", 371*b*", 471*b*", 571*b*" such that the working fluid F returned after flowing along the heat pipe 272, 372, 472, 572 can be introduced into a space between the heat case 271*a*, 371*a*, 471*a*, 571*a* and the passive heating part 271*b*", 371*b*", 471*b*", 571*b*". That is, the inlet 271*d*, 371*d*, 471*d*, 571*d* of the heating unit 271, 371, 471, 571 is formed on an outer circumference of a portion of the heater case 271*a*, 371*a*, 471*a*, 571*a*, which covers the passive heating part 271*b*", 371*b*", 471*b*", 571*b*".

As aforementioned, the working fluid F is reheated by the heater 271*b*, 371*b*, 471*b*, 571*b* after returned through the inlet 271*d*, 371*d*, 471*d*, 571*d*, and then discharged through the outlet 271*c*, 371*c*, 471*c*, 571*c*. Considering such flowing direction of the working fluid F and an upward flow characteristic of the heated working fluid F, the outlet 271*c*, 371*c*, 471*c*, 571*c* of the heating unit 271, 371, 471, 571 is formed higher than the inlet 271*d*, 371*d*, 471*d*, 571*d*.

Figure 5:
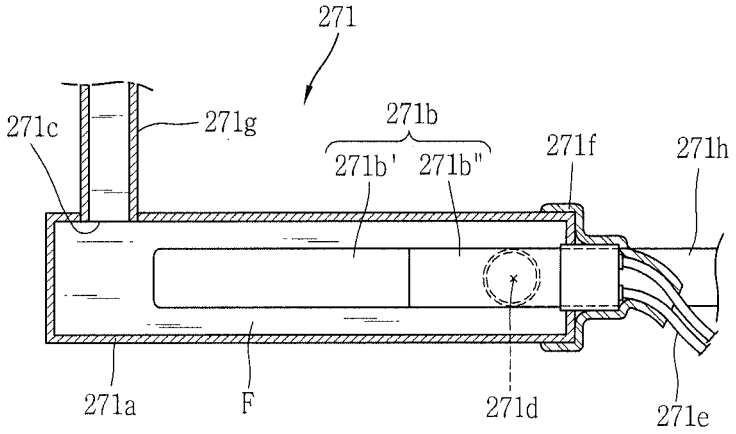
FIGS. 5 to 8 are conceptual views illustrating variations of a heating unit applied to the defrosting device of FIG. 3.

As one example, FIG. 5 illustrates that the inlet 271*d* of the heating unit 271 is formed on an outer surface of the heater case 271*a* located in a left and right direction of the heater case 271*a* and the outlet 271*c* of the heating unit 271 is formed on an upper outer surface of the heater case 271*a*. Here, an outlet pipe 271*g* connected to the outlet 271*c* preferably extends to an upper side of the heater case 271*a*. Meanwhile, a return pipe 271*h* connected to the inlet 271*d* may be arranged in parallel to the heater case 271*a*.

Figure 6:
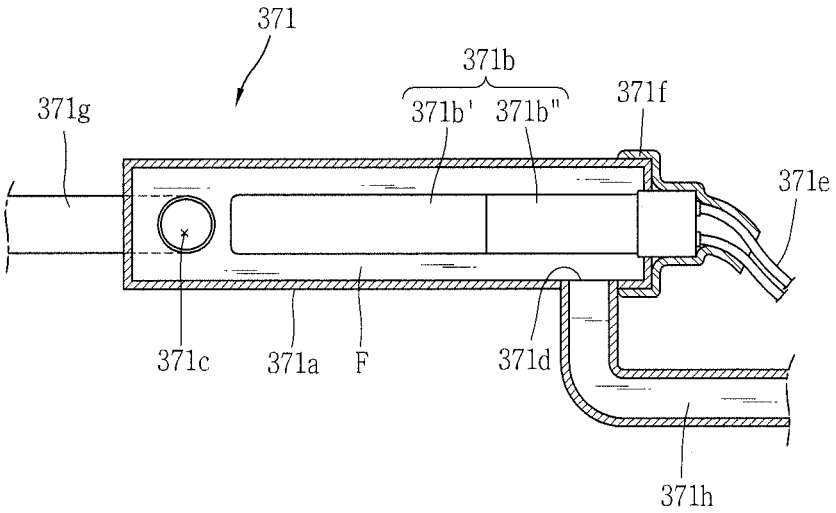

As another example, FIG. 6 illustrates that the inlet 371*d* of the heating unit 371 is formed on a lower outer surface of the heater case 371*a* and the outlet 371*c* of the heating unit 371 is formed on an upper outer surface of the heater case 371*a*. Here, an outlet pipe 371*g* connected to the outlet 371*c* preferably extends to an upper side of the heater case 371*a*. Meanwhile, a return pipe 371*h* connected to the inlet 371*d* may extend to a lower side of the heater case 371*a* (or extending downward and bent to extend horizontally).

The two examples may be applied to a structure that the outlet pipe 271*g*, 371*g* is connected directly to the perpendicular extending portion of the heat pipe (not illustrated). That is, a continuous flow that the working fluid F heated by the heater 271*b*, 371*b* flows upward to be discharged through the outlet 271*c*, 371*c* located at the upper side of the heater case 271*a*, 371*a* can be formed. This may result in a smooth discharge of an air layer due to film boiling even in a state that the heating unit 271, 371 is arranged horizontally.

Figure 7:
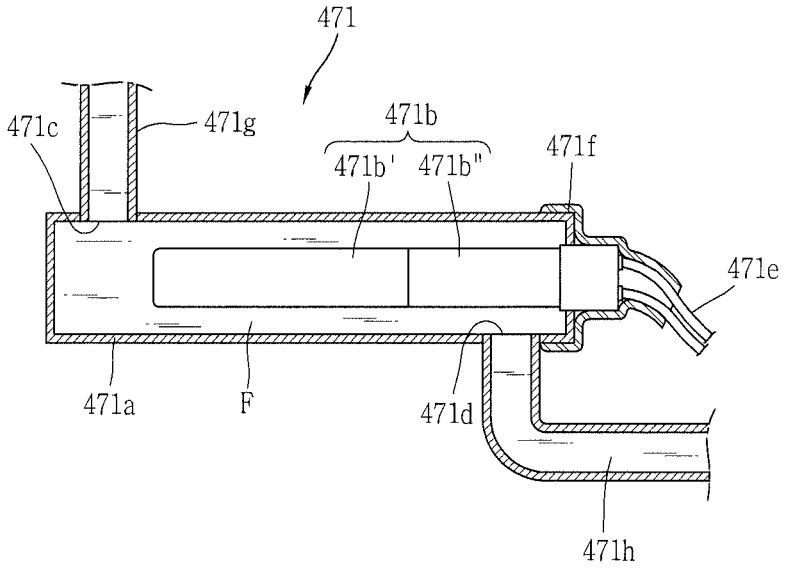

As another example, FIG. 7 illustrates that the inlet 471*d* of the heating unit 471 is formed on a lower outer surface of the heater case 471*a* and the outlet 471*c* of the heating unit 471 is formed on an outer surface of the heater case 471*a* located in a left and right direction of the heater case 471*a*. Here, a return pipe 471*h* connected to the inlet 471*d* can extend to a lower side of the heater case 471*a* (or extending downward and bent to extend horizontally) and an outlet pipe 471*g* connected to the outlet 471*c* can be arranged in parallel to the heater case 471*a*.

Figure 8:
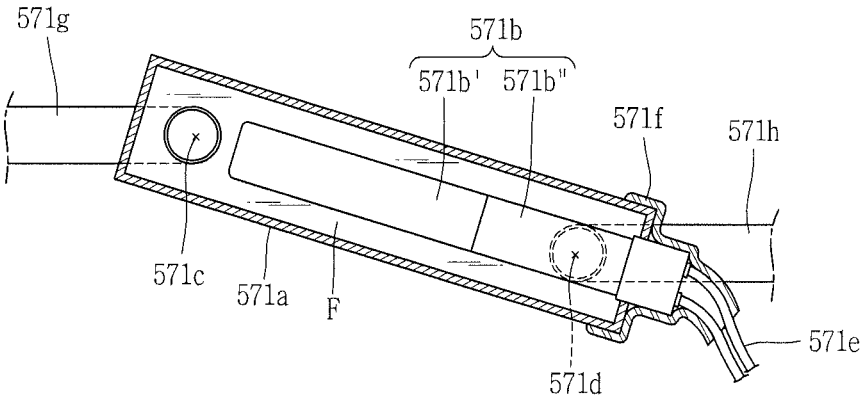

In addition, referring to FIG. 8, the heating unit 571 may also be arranged to be upwardly inclined such that one side thereof with the outlet 571*c* is located higher than another side with the inlet 571*d*. With the structure, the outlet 571*c* is located higher than the inlet 571*d* and also the heater case 571*a* itself is upwardly inclined. This is a structure which is appropriate for the characteristic that the working fluid F heated by the heater 571*b* flows upward. Accordingly, this structure can form a continuous flow of the working fluid F heated by the heater 571*b* that the heated working fluid F flows upward to be discharged through the outlet 571*c* located at the upper side of the heater case 571*a*. This may result in a smooth discharge of an air layer generated due to film boiling even in a state that the heating unit 571 is arranged horizontally.

Figure 9:
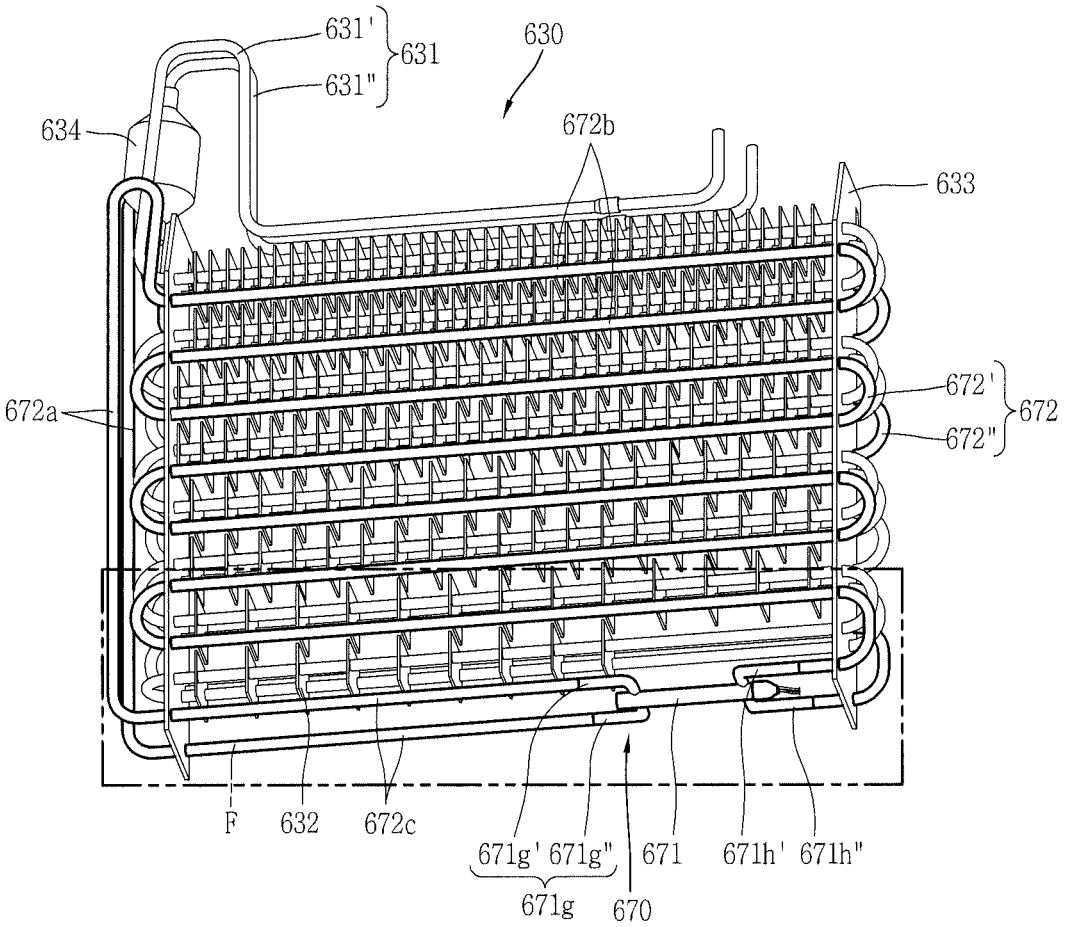
FIG. 9 is a conceptual view illustrating another embodiment of a defrosting device applied to FIG. 1.
Figure 10:
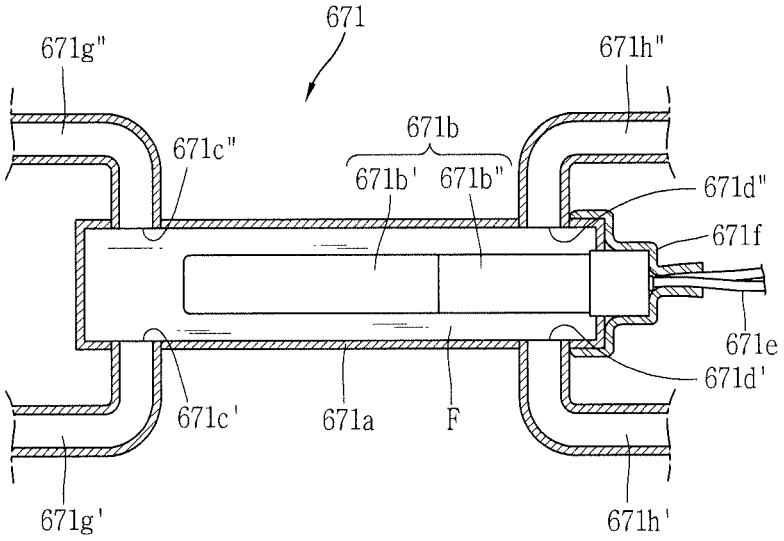
FIG. 10 is a sectional view of a heating unit illustrated in FIG. 9.

FIG. 9 is a conceptual view illustrating another embodiment of a defrosting device 670 applied to FIG. 1, and FIG. 10 is a sectional view of a heating unit 671 illustrated in FIG. 9.

Referring to FIGS. 9 and 10, a cooling pipe 631 is repetitively bent into a zigzag form so as to generate plural steps (columns). This embodiment illustrates that the cooling pipe 631 is provided with a first cooling pipe 631' and a second cooling pipe 631" formed at a front portion and a rear portion of an evaporator 630, respectively, to form second rows. The cooling pipe 631 may be made of an aluminum material and filled therein with refrigerant.

A heating unit 671 is arranged at a lower portion of an evaporator 630. As illustrated, the heating unit 671 may be arranged lower than the lowermost step of the cooling pipe 631. The heating unit 671 may be arranged at a lower end portion of one side of the evaporator 630. A horizontal extending portion 672*c* of the heat pipe 672 may be connected to an outlet pipe 671*g* of the heating unit 671 and extend in an extending direction of the lowermost step of the cooling pipe 631. This structure can arouse an increase in a heat transfer with respect to the lowermost step of the cooling pipe 631.

The heating unit 671 includes a heater case 671*a* and a heater 671*b*, and the heater 671*b* includes an active heating part 671*b*' and a passive heating part 671*b*". Those components will be understood by the description of the foregoing embodiment, and description thereof will be omitted.

The heat pipe 672 may be configured as a first heat pipe 672' and a second heat pipe 672" arranged into two rows at the front and rear portion s of the evaporator 630, respectively. This example illustrates a structure that the first heat pipe 672' is arranged at the front of the first cooling pipe 631' and the second heat pipe 672" is arranged at the rear of the second cooling pipe 631" so as to form two rows.

As such, when the heat pipe 672 is configured into two rows, the working fluid F may not uniformly be introduced into the first and second heat pipes 672' and 672", which may cause a temperature difference between the first heat pipe 672' and the second heat pipe 672". To minimize the temperature difference, the first and second heat pipes 672' and 672" preferably have the same length. This drawing exemplarily illustrates a structure that the first and second heat pipes 672' and 672" have the same length and also are arranged in the same shape.

Meanwhile, in this structure, each of the first and second heat pipes 672' and 672" is connected to an inlet and an outlet of the heating unit 671.

To this end, the outlet of the heating unit 671 is configured as a first outlet 671*c*' and a second outlet 671*c*", and first and second outlet pipes 671*g*' and 671*g*" extend from the first and second outlets 671*c*' and 671*c*", respectively, to be connected to one end portion of the first heat pipe 672' and one end portion of the second heat pipe 672". The working fluid F in a gaseous state, heated by the heating unit 671, is introduced into the first and second outlets 671*c*' and 671*c*". The first and second outlets 671*c*' and 671*c*" may be formed on both sides of an outer circumference of the heater case 671*a*, respectively, and an active heating part 671*b*' or an empty space located at the front of the active heating part 671*b*' may be located between the first and second outlets 671*c*' and 671*c*".

Also, the inlet of the heating unit 671 is configured as a first inlet 671*d*' and a second inlet 671*d*", and first and second return pipes 671*h*' and 671*h*" extend from the first and second inlets 671*d*' and 671*d*", respectively, to be connected to another end portions of the first and second heat pipes 672' and 672". The working fluid F in a liquid state, cooled while flowing along each heat pipe 672' and 672", is introduced into the first and second inlets 671*d*' and 671*d*". The first and second inlets 671*d*' and 671*d*" are formed on both sides of an outer circumference of the heater case 671*a* with interposing a passive heating part 671*b*", respectively.

Meanwhile, the heat pipe 672 may be configured to be accommodated between a plurality of cooling fins 632 fixed to each step of the cooling pipe 631. With the structure, the heat pipe 672 is arranged between the steps of the cooling pipe 631. Here, the heat pipe 672 may be configured to be brought into contact with the cooling fins 632.

Hereinafter, embodiments having a changed structure of the outlets 671*c*' and 671*c*" of the heating unit 671 illustrated in FIG. 10 will be described with reference to FIGS. 11 and 12.

Figure 11:
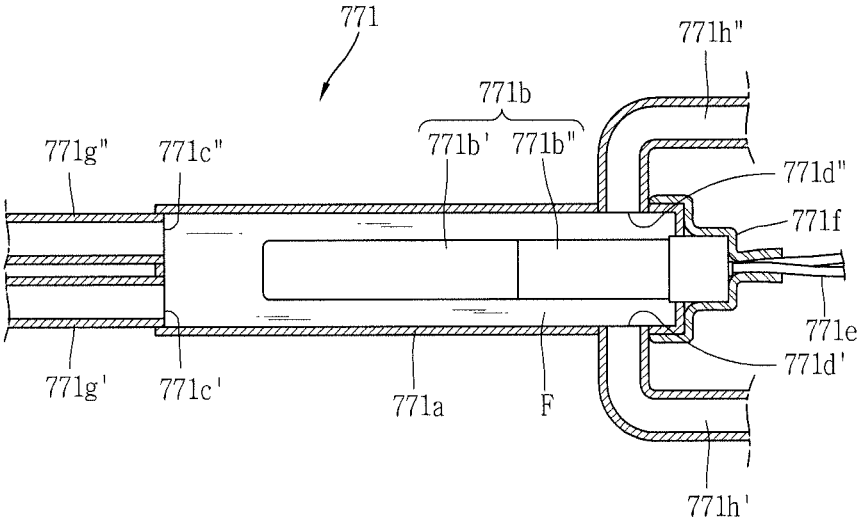
FIGS. 11 and 12 are conceptual views illustrating variations of the heating unit illustrated in FIG. 10.

First, referring to FIG. 11, an outlet of a heating unit 771 is configured as a first outlet 771*c*' and a second outlet 771*c*" formed in parallel on a front surface of the heater case 771*a*. Considering positions, the first and second outlets 771*c*' and 771*c*" are located at the front of an active heating part 771*b*' of a heater 771*b*.

First and second outlet pipes 771*g*' and 771*g*" are connected to the first and second outlets 771*c*' and 771*c*", respectively. The first and second outlet pipes 771*g*' and 771*g*" extend in parallel in a lengthwise direction of the heater case 771*a* to be connected to horizontal extending portions or perpendicular extending portions of first and second heat pipes (not illustrated), respectively.

That is, the working fluid F in a gaseous state, heated by the heating unit 771, is discharged in a dividing manner into the first and second outlet pipes 771*g*' and 771*g*" connected to the first and second outlets 771*c*' and 771*c*", respectively, so as to circulate along the first and second heat pipes.

Figure 12:
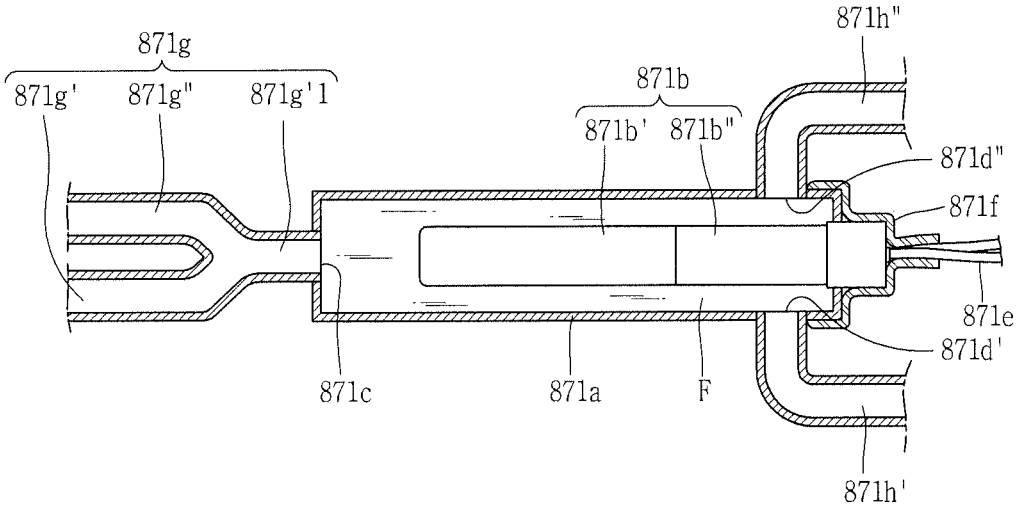

Next, referring to FIG. 12, an outlet 871*c* of a heating unit 871 is formed on a front surface of a heater case 871*a*. Considering a position, the outlet 871*c* of the heating unit 871 is located at the front of an active heating part 871*b*' of a heater 871*b*.

An outlet pipe 871*g* is connected to the outlet 871*c*, and the outlet pipe 871*g* includes a connecting portion 871*g*1, a first outlet portion 871*g*' and a second outlet portion 871*g*".

The connecting portion 871*g*1 is connected to the outlet 871*c* of the heating unit 871, and the first and second outlet portions 871*g*' and 871*g*" are branched out from the connecting portion 871*g*1 and then connected to the first and second heat pipes (not illustrated), respectively.

That is, the working fluid F in the gaseous state, heated by the heating unit 871, is discharged into the heat pipe through the outlet pipe 871*g* connected to the outlet 871*c*, and then flows through the single connecting portion 871*g*1 of the outlet pipe 871*g*1. The working fluid F is then introduced in a dividing manner into the first and second outlet portions 871*g*' and 871*g*" so as to circulate along the first and second heat pipes, respectively.

Figure 13:
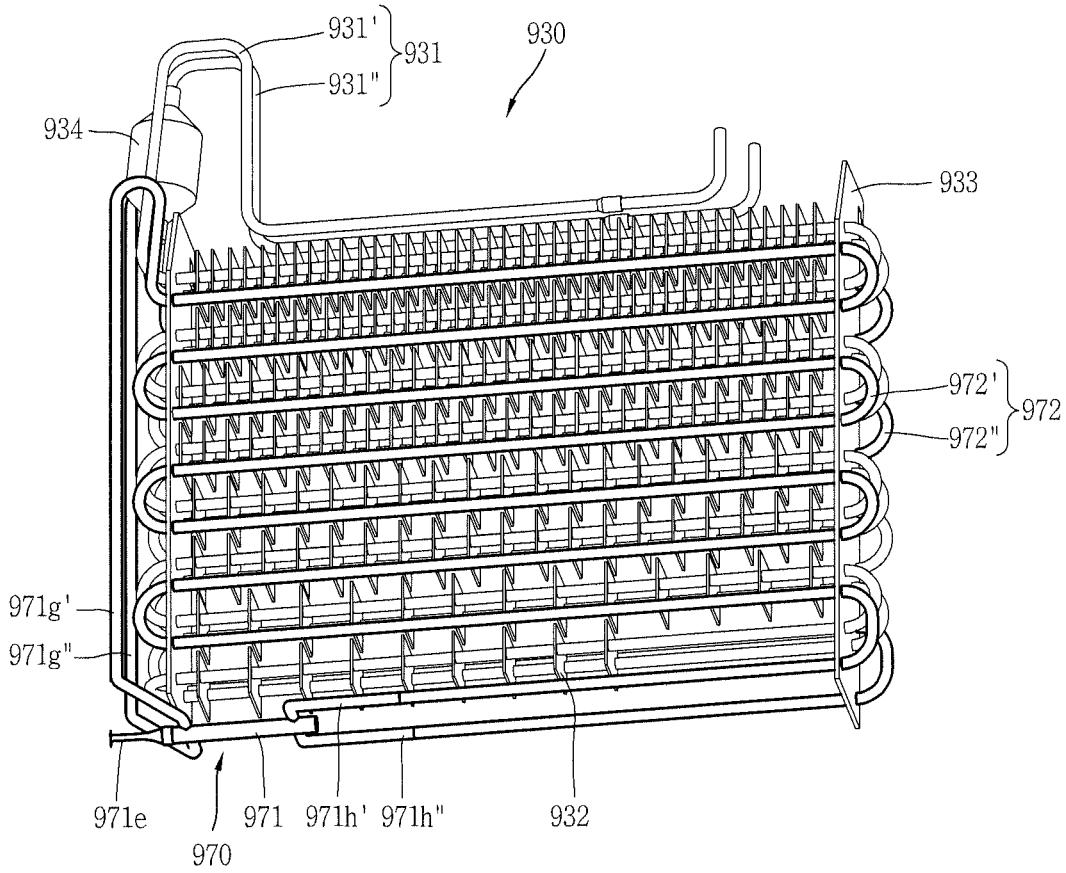
FIG. 13 is a conceptual view illustrating another embodiment of a defrosting device applied to FIG. 1.
Figure 14:
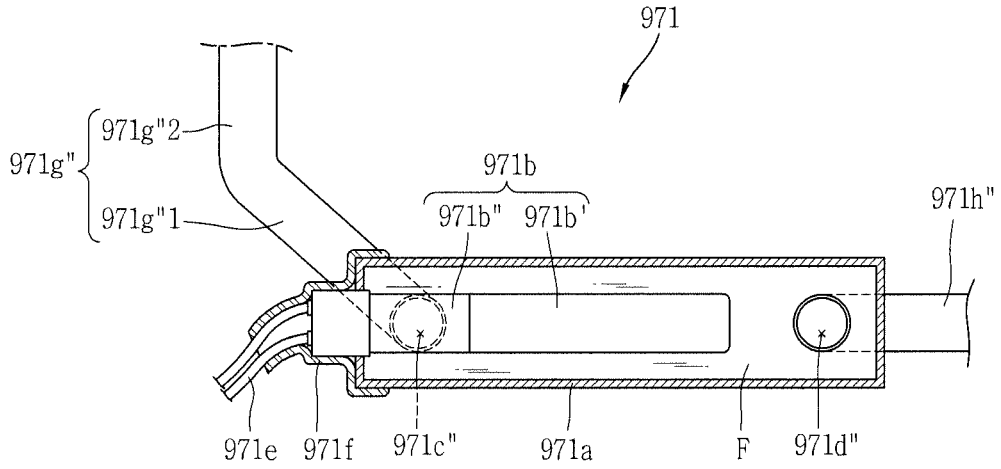
FIG. 14 is a sectional view of a heating unit illustrated in FIG. 13.

FIG. 13 is a conceptual view illustrating another embodiment of a defrosting device 970 applied to FIG. 1, and FIG. 14 is a sectional view of a heating unit 971 illustrated in FIG. 13.

A cooling pipe 931 and a heat pipe 972, as illustrated in the foregoing embodiment, may be configured into two rows.

The heating unit 971 is arranged at a lower portion of the evaporator 930. These drawings exemplarily illustrate that the heating unit 971 is located at a lower portion of one side of an evaporator 930 where an accumulator 934 is located. Here, a heater case 971*a* may be arranged at an inner side of one of supporters 933.

The heating unit 971 includes a heater case 971*a* and a heater 971*b*, and the heater 971*b* includes an active heating part 971*b*' and a passive heating part 971*b*". Those components will be understood by the description of the foregoing embodiment, and description thereof will be omitted.

However, this embodiment includes an internal structure of the heating unit 971 and a connecting structure with a heat pipe 972, which are different from those included in the foregoing embodiments.

Referring to FIG. 14, the active heating part 971*b*' and the passive heating part 971*b*" extends in a lengthwise direction of the heater 971*b*. Here, from the perspective of a flow of the working fluid F in the order of return-(re)heat-discharge, the working fluid F flows toward the passive heating part 971*b*" via the active heating part 971*b*'. Structurally, the passive heating part 971*b*" is disposed at a front side adjacent to an outlet 971*c* of the heating unit 971, and the active heating part 971*b*' extends from the passive heating part 971*b*" to the rear of the heating unit 971.

The heater 971*b* may be inserted into a front side of the heater case 971*a* to be fixed to the heater case 971*a*. A front end of the heater 971*b*, namely, the passive heating part 971*b*" may be fixedly sealed on a front end portion of the heater case 971*a*, and a rear end of the heater 971*b*, namely, the active heating part 971*b*' may extend toward the rear of the heater case 971*a*.

Regarding this in view of the flow of the working fluid F, an inner space of the heater case 971*a* corresponding to the inlet 971*d* is left empty, and the returned working fluid F is introduced into the empty space. The active heating part 971*b*' is provided at the front of the empty space such that the working fluid F introduced into the empty space can be reheated. The outlet 971*c* is formed on an outer circumference of the heater case 971*a* corresponding to the active heating part 971*b*' or the passive heating part 971*b*" located at the front of the active heating part 971*b*', such that the reheated working fluid F is discharged therein.

When the cooling pipe 931 and the heat pipe 972 are configured into two rows, the outlet includes first and second outlets 971*c*' and 971*c*" that are formed on both sides of an outer circumference of the heater case 971*a* with interposing the active heating part 971*b*' or the passive heating part 971*b*" located at the front of the active heating part 971*b*', respectively, to be connected to first and second heat pipes 972' and 972". An inlet includes first and second inlets 971*d*' and 971*d*" formed on both sides of an outer circumference of the heater case 971*a* forming the empty space, such that the returned working fluid F can be introduced into the empty space at the rear of the active heating part 971*b*'.

Here, the passive heating part 971*b*" extends from the front of the active heating part 971*b*' and at least part of the passive heating part 971*b*" is externally exposed at a front end of the heater case 971*a*. The externally-exposed passive heating part 971*b*" of the heater case 971*a* emits heat of the heater 971*b* to outside so as to reduce a surface load of the heater 971*b*. When the surface load of the heater 971*b* is reduced, the overheat of the heater 971*b* can be prevented, thereby ensuring reliability and extending the lifespan of the heater 971*b*.

As aforementioned, the heater case 971*a* may be disposed at an inner side of one of the supporters 933, taking into account the exposure of the passive heating part 971*b*". That is, with the structure, the forwardly-exposed passive heating part 971*b*" and a lead wire 971*e* connected to the passive heating part 971*b*" can be prevented from excessively protruding from one side of the evaporator 930.

Meanwhile, in this embodiment, the heat pipe 972 includes a perpendicular extending portion 972*a* and a heat sink portion 972*b*. The perpendicular extending portion 972*a* extends to an upper side of the evaporator 930 such that the working fluid F heated by the heating unit 971 flows upward, and the heat sink portion 972*b* extends from the perpendicular extending portion 972*a* into a zigzag form along the cooling pipe 931 of the evaporator 930.

Here, the perpendicular extending portion 972*a* is arranged at an outer side of one of the supporters 933 and the heating unit 971 is arranged at an inner side of the one supporter 933.

The outlet 971*c* of the heater case 971*a* is connected to the outlet pipe 971*g* and the outlet pipe 971*g* is connected to the heat pipe 972 such that the hot working fluid F discharged is supplied into the heat pipe 972.

The outlet pipe 971*g* connects the outlet 971*c* of the heating unit 971 to the perpendicular extending portion 972*a*, and includes a first extending portion 971*g*"1 and a second extending portion 971*g*"2 for the connection between the outlet 971*c* and the perpendicular extending portion 972*a* with the spaced distance. The first extending portion 971*g*"1 is upwardly inclined to outside of the evaporator 130 and the second extending portion 971*g*"2 extends upward from the first extending portion 971*g*"1 in a bent shape to be connected to the perpendicular extending portion 972*a*.

It should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. A refrigerator, comprising:

an evaporator that has a plurality of cooling fins that extend vertically and horizontally and that are spaced apart from one another, a refrigerant pipe that extends horizontally through the plurality of cooling fins and that has a bent portion, and a defrosting device configured to remove frost generated by the evaporator, wherein the defrosting device comprises:

a heater case that is located at a lower portion of the plurality of cooling fins and that defines an inner space that extends horizontally;

an outlet located at the heater case;

an inlet located at the heater case and spaced apart from the outlet horizontally;

a heat pipe that communicates with the outlet and the inlet, that extends horizontally, and that has a bent portion;

a heater that extends horizontally from a position adjacent to the inlet toward the outlet, the heater being inserted in the inner space of the heater case; and a working fluid accommodated in the inner space of the heater case and the heat pipe, wherein a first portion of the heater is spaced apart from a first horizontal end of the heater case and is configured to actively generate heat to heat the working fluid, wherein a second portion of the heater extends from the first portion of the heater and is connected to a second horizontal end of the heater case, the second portion of the heater being configured to be heated to a second temperature that is lower than a first temperature of the first portion of the heater, wherein the inlet is spaced apart from the first portion of the heater, faces the second portion of the heater, and is provided at an outer circumferential surface of the heater case such that a returned working fluid is introduced into a space between the heater case and the second portion of the heater, wherein the outlet is provided at the outer circumferential surface of the heater case at a position between the first horizontal end of the heater case and the first portion of the heater such that a predetermined amount of working fluid is gathered between the first horizontal end of the heater case and the outlet, wherein the inlet and outlet are positioned along a same horizontal axis, and wherein the working fluid is filled in an annular space between an inner, circumferential surface of the heater case and an outer circumferential surface of the heater such that the heater is configured to be soaked below a surface of the working fluid in the heater case.

2. The refrigerator of claim 1, wherein the heater is inserted into the inner space of the heater case through the second horizontal end of the heater case.

3. The refrigerator of claim 1, wherein the heater further comprises a lead wire located within the heater to generate heat, and wherein the lead wire is wound a plurality of times within the first portion of the heater.

4. The refrigerator of claim 1, wherein a first end of the second portion of the heater is externally exposed at the second horizontal end of the heater case, and wherein the externally exposed first end of the second portion of the heater is configured to discharge heat of the heater.

5. The refrigerator of claim 1, wherein a return pipe is extended from the inlet and connected to the heat pipe, and wherein an inner diameter of the return pipe is greater than 5 mm and smaller than 7 mm.

6. The refrigerator of claim 1, wherein the heat pipe comprises:

a horizontal extending portion arranged at a lower portion of the evaporator and connected to the heater case to allow a supply of the working fluid heated by the heater, a perpendicular extending portion connected to the horizontal extending portion and extending to an upper side of the evaporator such that the heated working fluid flows upward, and a heat sink portion that extends from the perpendicular extending portion into a zigzag shape along the refrigerant pipe of the evaporator.

7. The refrigerator of claim 1, wherein the outlet is disposed between the first horizontal end of the heater case and a first end of the first portion of the heater.

* * * * *